United States Patent [19]

Chao et al.

[11] 4,028,828

[45] June 14, 1977

[54] LIGHTING DISPLAY SYSTEM

[76] Inventors: Albert Chao; Ethel Chao, both of 407 Glendale Road, Northvale, N.J. 07647

[22] Filed: Apr. 2, 1976

[21] Appl. No.: 673,307

[52] U.S. Cl. ..... 40/130 D; 40/142 R

[51] Int. Cl.[2] ..... G09F 13/00

[58] Field of Search ..... 40/130 D, 130 R, 130 E, 40/143, 142 R, 140, 125 R, 125 H

[56] References Cited

UNITED STATES PATENTS

| | | | |
|---|---|---|---|
| 1,192,982 | 8/1916 | Bristol et al. | 40/130 D |
| 2,823,475 | 2/1958 | Packard | 40/130 R |
| 3,221,432 | 12/1965 | Gold | 40/130 D |
| 3,447,253 | 6/1969 | Coad | 40/130 R |
| 3,523,382 | 8/1970 | Dreyer | 40/125 R |
| 3,553,870 | 1/1971 | Rudolph | 40/130 R |

OTHER PUBLICATIONS

Spell-O-Light Ad, 1942, Garrison-Wagner Co.

*Primary Examiner*—John F. Pitrelli

[57] ABSTRACT

A novel lighting display system for numerous uses consisting of the following members. A mounting board containing two channels across the boards length, each channel carrying one electrical conductor; and plastic numerals, letters, or other characters, which when inserted into the boards channels are securely attached to the board, come in contact with electrical conductors in the channels and become illuminated. The plastic characters are constructed by encasing miniature light bulbs, mounted in parallel electrical circuit on a printed circuit board, in a plastic material. Various characters can be combined to form an illuminated message, word, or series of numerals.

2 Claims, 7 Drawing Figures

LIGHTING DISPLAY SYSTEM

This invention relates generally to electrically illuminated displays. A principal object of this invention is to provide a lighting display which can be used easily and economically.

Another principal object of this invention is to provide a display board with the electrical contact built into it, capable of holding securely numerals, letters, or other characters, of any size, to form words, messages, or numeral sequences.

Yet another object is to provide letters, numerals, or other characters capable of being illuminated when attached and securely to the display board.

A further object of this invention is to provide an improved method of making the letters, numerals, or other characters capable of being illuminated when connected to an electrical circuit.

Further objects of this invention will become evident as the description proceeds.

To the accomplishment of the above and related objects, this invention may be embodied in the form illustrated in the accompanying drawing, attention being called to the fact, however, that the drawings are illustrative only, and that changes may be made in the specific construction illustrated and described within the scope of the appended claims.

Figure 1:
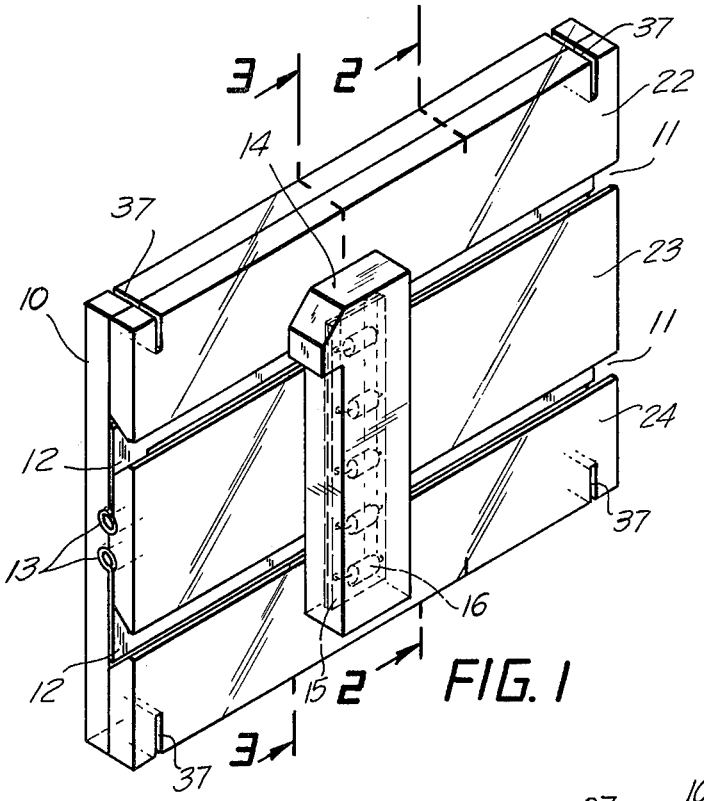
FIG. 1 is a perspective view of this invention showing the display board and a numeral 1, attached to the board.

Referring now to the drawings in detail and specifically to FIGS. 1 through 8, the reference numeral 10 represents the display board, typically made of plastic, wherein there are two channels 11 running lengthwise through and across the face of the display board 10. Within these channels 11 is a conductive strip 12 runs along the entire channel 11.

FIG. 1 illustrates the display board 10, channels 11 and conductive strips 12. In addition two sockets 13 used for plugging in a power cord, to provide power, are seen on the side of the display board 10 between the channels 11. Securely attached to the front of the display board 10 is a numeral 14, in this case the numeral 1. This numeral 14 is constructed by molding a printed circuit board 15 in a plastic material which is transparent or semi-transparent into any desired shape and color. Mounted on the printed circuit board 15 are mini-light bulbs 16 with legs 17. These legs 17 are inserted in holes 18 on the printed circuit board 15 in such a way that one leg 17 of each light 16 is soldered to one of the two conductive strips 19 on the bottom side of the printed conductive strip 19 on the bottom side of the printed circuit board 15.

Figure 2:
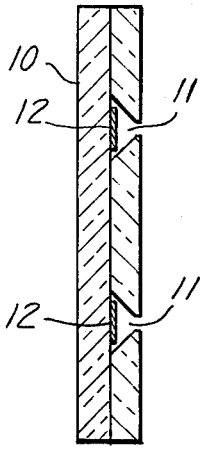
FIG. 2 is a cross section of the display board along line 2—2.

FIG. 2, a cross section of the display board 10 shows the shape of the channels 11. In this case the shape of the channel 11 is triangular, however any shape capable of holding the character 14 in place is acceptable.

The conductive strips 12 can be seen at the bottom of each channel 11.

Figure 3:
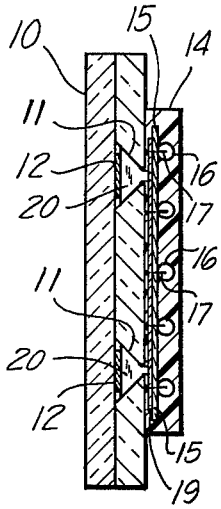
FIG. 3 is a cross section of the display board and numeral along line 3—3.

FIG. 3, a cross section of the display board 10, illustrates how the character 14 fits into the channel 11 and is thus held in place. The extensions 20, one from each conductive strip 19 of the printed circuit board 15, being electrically conductive, are of such a shape that they fit into the channel 11 and are held securely attached to the display board face 10, as well as being kept in constant contact with the two conductive strips 12 in the channel 11. When the extensions 20 of the numeral or character 14 are inserted into the channel 11 at one end of display board 10, the numeral 11 or character 14 can be slid along the face of the board 10, and positioned any point along the way. The extensions 20 can be made with a small leaf spring attachment to its bottom edge where it contacts the conductive strips 12 to insure a constant connection between the extension 20, and the conductive strip 20.

Figure 4:
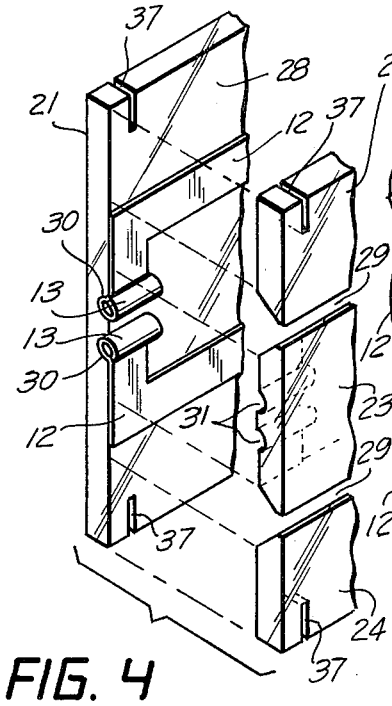
FIG. 4 is an exploded detail of the display board showing its construction.

FIG. 4 shows an explosion view of the construction of the display board 10, consisting of the board back 21 and top face 22, middle face 23, and bottom face 24. When these three pieces, top face 22, middle face 23, and bottom face 24 are positioned on the front side 28 of the board back 21 with a space 29 formed between the top face 22 and middle face 23, and between the middle face 23 and bottom face 24, two channels 11 are formed. As stated above the shape of the channels 11 and character extensions 20 are illustrated as triangular in shape, but can be made in various shapes; a "T" shaped channel for example.

Two semicircular grooves 30 are formed near the center of each end of the display board back 21, between the conductive strips 12; and exactly opposite these grooves 30 are formed two semicircular grooves 31 at each end of the middle face member 23. Secured into each groove 30 at each end of the display board back 21 is a socket 13. These sockets 13, two at each end of the display board 10, are of such a size that the power source plug can be inserted into these. With a set of sockets 13 at each end of the board 10, the power source can be plugged into either end. The power source will typically be a 115V A.C. source connected to a transformer which provides about 6 volts D.C.; however a battery source could be used.

The two conductive strips 12 which are thin copper or similar material traverse across the front side 28 of the board back 21 from one end to the other. Each end of each conductive strip 12 is connected to the socket 13 nearest to it. Hence when a power source with one positive and one negative terminal is plugged into the sockets 13 at one end of the display board 10, one conductive strip 12 becomes the positive lead, and the other conductive strip 12 becomes the negative lead. Further, when a numeral 14 or other character is secured to the board 10 with one extension 20 in each channel 11, one extension 20 contacting one conductive strip 12 becomes the positive lead, and the other extension 20 contacting the other conductive strip 12 becomes the negative lead. Further, these extensions 20 are connected internally to the printed circuit board 15, making one printed circuit board conductive strips 19 positive, and the other printed circuit board conductive strip 19 negative. This being completed, power is provided to the light bulbs 16 which illuminate. As constructed all light bulbs 16 of each numeral 14 or character used are connected in a parallel electrical circuit.

Figure 5:
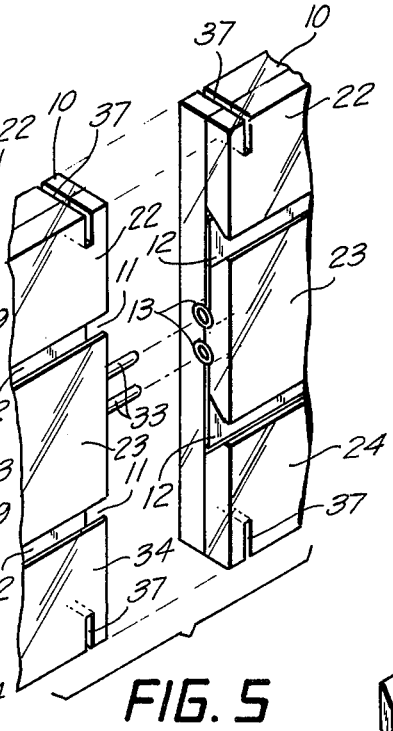

Referring now to FIG. 5 illustrates how two display boards 10 may be connected together to accomodate a larger message. Since there are sockets 13 at each end of each display board 10, connecting rods 33 are inserted into one set of sockets. These connecting rods 33 are circular shaped, conductive links approximately twice the length of the socket 13. When the connecting rod 33 are inserted into one set of sockets 13 on one display board 10, a second display board 10 can be attached by simply inserting the sockets 13 of the second display board onto the connecting rods 33 already inserted in the sockets 13 of the first display board. These connecting rods 33 now continue the parallel electrical circuit by electrically connecting the conductive strips 12 of the second display board 10 to the conductive strips 12 of the first display board 10.

If necessary for support, the display boards 10 connected together can be reinforced by installing a clip 34 at the top and/or bottom edge of the two display boards 10 where they join. This clip 34 has front and back extensions 35, and side extensions 36 to provide vertical and horizontal strength to the joint. When installed the front and back extensions 35 of the clip contact the front and back of the display board 10 respectively, at the top and/or bottom edge of the display board 10 near the joint of the two display boards 10; the clip side extensions 36 fit into the slots 37 on the top and/or bottom edge of display boards 10 near the joint. These slots 37 are provided near each end of each display board 10.

Figure 8:
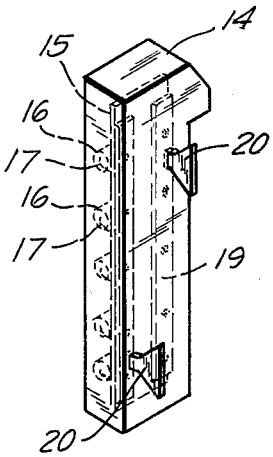
FIGS. 7 & 8 show perspective views of the numeral 1.
Figure 6:
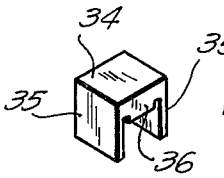
FIG. 6 is a perspective view of a clip used to hold two adjoining boards together.
Figure 7:
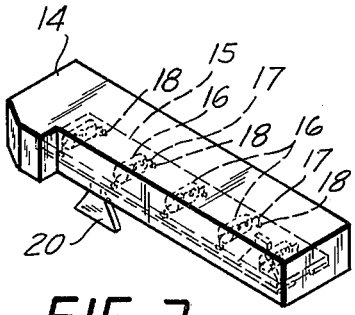

FIGS. 7 & 8 show the construction of the numeral 14 or characters used. Basically it is a printed circuit board 15 cut to the desired shape, having conductive strips 19 on the reverse side along the edges; further, mini light bulbs 16 of single or varied colors, with legs 17 are secured to the face of the printed circuit board 15, by inserting these legs 17 into holes 18 in the board 15. These legs 17 are then soldered to the respective conductive strips 19 on the back of the printed circuit board 15. After an adequate number of light bulbs 16 are added to describe the shape, the extensions 20 are attached by soldering one to each conductive strip 19, spaced a uniform distance to match the spacing of the channels 11 on the display board 10. The entire printed circuit board 15 with bulbs 16 is encased in a plastic, non-conductive material, and molded into the desired shape. The extensions 20 are not encased since they must enter the channels 11 and make contact with the display board conductive strips 12.

Thus an improved lighting display system is provided.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A lighting display system comprising; a display board to be supported on a wall, desk, or other surface; and a set of letters, numerals, or other characters to be secured to said display board for illumination; said characters comprise a hollow molded translucent top and a flat base of matching configuration having a printed circuit on the top surface thereof; illumination means comprising miniature light bulbs mounted on said top surface of said flat base; said display board having two channels running longitudinally across the surface thereof, conductive strips at the base of each channel and running the length of said channels; said conductive strips attached to sockets at each end of the display board; said sockets thereof are used for connection to an electrical supply or for connecting successive display boards to each other conductive extensions on the rear surface of said base character of a shape complementary to the shape of said channels; said extensions fitting securely in said channels and making adequate electrical connection with said conductive strips in said channels, connecting pins for carrying power from one display board to the next; said connecting pins are conductive and fit into said sockets on adjoining lateral edges of connecting display boards; said connecting pins being removable when unnecessary; clips to strengthen the joint of adjoining boards and slots provided across the top and bottom edges at each end of the display boards; said clips are attached to the adjoining display boards at the top joints and have extensions which fit into said slots on the top and bottom edge of each display board to provide lateral and vertical support to the joint.

2. The combination as set forth in claim 1 wherein said miniature light bulbs are baseless and are mounted in parallel electrical conductive metallic lines printed on said character base; said miniature bulbs being soldered to the surface of the printed circuit; said printed circuit base having two conductive extensions connected to each of the two parallel lines which extensions become positive and negative conductive power tracks of the display board; said printed circuit base and the top molded translucent character are completely sealed together.

* * * * *